US007780112B2

(12) United States Patent
Granger et al.

(10) Patent No.: US 7,780,112 B2
(45) Date of Patent: Aug. 24, 2010

(54) LOCK MECHANISM FOR A DISPENSER, ROLL OF MATERIAL AND END PLUG THEREFOR, AND METHOD FOR INSERTING A ROLL OF MATERIAL INTO SUCH LOCK MECHANISM

(75) Inventors: Maurice Granger, 17 rue Marcel Pagnol, Saint Priest En Jarez (FR) 42270; Stefan Kristo, Gothenburg (SE); Jonas Randers, Partille (SE); Bjorn Hagman, Surte (SE)

(73) Assignee: Maurice Granger, Saint Priest En Jarez (FR)

( * ) Notice: Subject to any disclaimer, the term of this patent is extended or adjusted under 35 U.S.C. 154(b) by 651 days.

(21) Appl. No.: 10/599,457

(22) PCT Filed: Mar. 30, 2005

(86) PCT No.: PCT/IB2005/000810

§ 371 (c)(1),
(2), (4) Date: Feb. 21, 2007

(87) PCT Pub. No.: WO2005/094653

PCT Pub. Date: Oct. 13, 2005

(65) Prior Publication Data

US 2008/0229791 A1 Sep. 25, 2008

(30) Foreign Application Priority Data

Apr. 1, 2004 (FR) ..... 04 50648
Dec. 15, 2004 (FR) ..... 04 53010

(51) Int. Cl.
*B65H 75/18* (2006.01)

(52) U.S. Cl. ..... 242/599.3; 242/596.7

(58) Field of Classification Search ..... 242/596, 242/596.4, 596.5, 596.6, 596.7, 598.3, 598.4, 242/599, 599.3, 129.6, 129.62; 83/649; 225/46, 225/47; 400/613
See application file for complete search history.

(56) References Cited

U.S. PATENT DOCUMENTS 1,711,353 A * 4/1929 Johnson ..... 242/599.3

(Continued)

FOREIGN PATENT DOCUMENTS

AT 398 747 B 1/1995

(Continued)

*Primary Examiner*—William A Rivera
(74) *Attorney, Agent, or Firm*—Heslin Rothenberg Farley & Mesiti P.C.

(57) ABSTRACT

A lock mechanism for a dispenser in combination with an exchangeable roll of material is provided, wherein the roll includes at least one end plug with a bearing pin for mounting the roll to the lock mechanism. The lock mechanism comprises a lock housing with a guide slot for insertion of the bearing pin. The guide slot has a first section with a first width and a second section with a second width which is smaller than the first width. First and second sections are arranged in a direction perpendicular to the longitudinal extension of the guide slot and in a longitudinal direction of the bearing pin. A sliding element is mounted to the lock housing and movable between a first position closing or narrowing the width of the guide slot and a second position opening the guide slot. A lock element is mounted to the sliding element and is rotationally movable about an axis of rotation between a locked position and an unlocked position. The lock element has an engagement portion which, in a locked position, is engaged with a locking geometry of the lock housing.

27 Claims, 5 Drawing Sheets

U.S. PATENT DOCUMENTS

| | | | | |
|---|---|---|---|---|
| 4,230,286 | A | 10/1980 | Charles | |
| 4,307,639 | A | 12/1981 | DeLuca | 83/337 |
| 5,997,195 | A | 12/1999 | Bürgin | 400/242 |
| 6,824,091 | B2 * | 11/2004 | Inana | 242/596.4 |
| 7,284,725 | B2 * | 10/2007 | Inana | 242/596.4 |
| 2003/0173451 | A1 | 9/2003 | Inana | 242/578.2 |
| 2004/0211853 | A1 * | 10/2004 | Inana et al. | 242/596.4 |

FOREIGN PATENT DOCUMENTS

| | | |
|---|---|---|
| DE | 94 06 941.7 | 6/1994 |
| WO | WO 96/23719 | 8/1996 |

* cited by examiner

LOCK MECHANISM FOR A DISPENSER, ROLL OF MATERIAL AND END PLUG THEREFOR, AND METHOD FOR INSERTING A ROLL OF MATERIAL INTO SUCH LOCK MECHANISM

CROSS REFERENCE TO RELATED APPLICATIONS

This is a 371 filing of International Application PCT/IB2005/000810 filed on Mar. 30, 2005 and published, in English, as International Publication No. WO 2005/094653 A1 on Oct. 13, 2005, and claims priority from of French Patent Application No. 0450648 filed on Apr. 1, 2004 and French Patent Application No. 0453010 filed on Dec. 15, 2004, all of which applications are hereby incorporated by reference herein, in their entirety.

TECHNICAL FIELD

The invention relates to the technical field of dispensers for paper rolls and the suitable geometry for inserting exchangeable paper rolls into such dispenser. In particular, the invention relates to a lock mechanism for such dispenser, a suitable roll of material and end plug for such lock mechanism and a method for inserting a roll of material into such lock mechanism.

PRIOR ART

Numerous prior dispensers are known for dispensing kitchen paper, toilet paper, foil, plastics wrapping sheet and other materials wound onto a roll. Usually, such dispensers are provided with a supporting frame having support members in the form of arms upon each of which an end of an exchangeable roll is rotatably mounted. The support arm usually carries a hub member rotatably supported thereon over which one end of the roll core is inserted in replacing the roll. To the other end of the roll, an end plug is secured which is inserted in a catcher mechanism in the other support arm of the dispenser. By means of providing an end plug only on one side of the roll, the correct placement of the supply roll relative to the dispensing mechanism and, consequently, the proper feeding of the sheet material is ensured.

In the prior art, different suggestions have been made in order to ensure the proper feeding of dispensers or to prevent the insertion of unauthorized paper rolls of inferior quality into a dispenser.

U.S. Pat. No. 2,334,689 deals with the problem to provide dispensers with means to prevent any but a particular type of towel roll being inserted. As a solution to this problem, the paper roll and the paper thereon are provided with a groove at one longitudinal end. Only paper rolls with such a groove can be inserted into the dispenser. If a paper roll without such groove but of shorter longitudinal dimensions is used, it can no longer rest on a support structure provided in the dispenser.

EP 0 657 134 B1 provides a solution to the problem to prevent the wrong insertion of paper rolls into a dispenser. The paper rolls are provided with plugs on both sides, the plug on the one side having a larger diameter and a slit which divides the pin into two crescent-shaped segments. This geometry is adapted to match a specific receiving geometry of the dispenser which is provided with corresponding depressions for receiving the crescent-shaped segments of the bearing pin.

Based on the object to prevent unauthorized use of paper rolls, U.S. Pat. No. 2,905,405 describes a coupling mechanism having openings of a special shape within a flange plate of the dispenser. The end plugs of the exchangeable replacement rolls have matching projections to be inserted through these openings. The projections of the end plugs inserted through the openings press-on leaf springs biasing them into a position in which they do not impede the proper operation of the dispenser. Only replacement paper rolls having all matching projections can be used in order to operate each individual leaf spring.

Another similar technical solution is known from U.S. Pat. No. 6,749,149 B1. The dispenser described therein has support arms for supporting a paper towel roll having a selected geometry with protrusions shaped to fit into matching openings in the end faces of the paper towel roll.

The above-described solutions serve the purpose to ensure the proper insertion of a roll of material provided with the matching geometry to some receiving structure. However, such paper rolls having a specific geometry with projections to be inserted in corresponding depressions in the receiving geometry are difficult to handle. The user cannot simply insert a replacement roll but has to check its proper orientation relative to the receiving structure. This, again, entails the danger of wrong operation or that the user applies undue pressure to push a replacement roll into the dispenser.

SUMMARY OF THE INVENTION

It is the object of the invention to provide a lock mechanism for a dispenser and the corresponding connecting structure for a roll of material therefor such that the insertion of a replacement roll is very easy but still the inadvertent use of a wrong or unauthorized roll is effectively prevented.

This object is solved by a lock mechanism for a dispenser in combination with an exchangeable roll of material with the features of claim 1. The end plug for a roll of material to be inserted into such inventive lock mechanism is defined by the features of claim 12. The method for inserting an exchangeable roll of material into the lock mechanism of a dispenser is described by the features of claim 21. Preferred embodiments are described in the dependent claims.

It is the basic idea of the invention to provide a lock mechanism for a dispenser in combination with an exchangeable roll of material which provides a key-lock-system and is very easy to operate if an exchangeable roll of material being provided with at least one end plug of the right geometry is used. The key of the system is the geometry of the bearing pin of the end plug, whereas the lock of the system is part of the dispenser. The dispenser is provided with a lock housing with a guide slot for insertion of the bearing pin. The guide slot is subdivided into sections of different widths wherein the different sections are arranged such that they extend in a longitudinal direction of the bearing pin of the end plug to be received. The different widths of the guide slot ensure that no end plug can be used if it has a bearing pin with dimensions exceeding the widths of the individual sections. On the other hand, the different sections serve to control the proper position of a replacement roll to be inserted. If the replacement roll is longitudinally shifted, the individual sections of the bearing pin do not enter the matching sections of the guide slot. In other words, the provision of different sections of the guide slot with different widths serves two purposes, the provision of a key-lock-system preventing the introduction of a "key with wrong dimensions", and the provision of a safety means which ensures the proper longitudinal position of the replacement roll when inserting into the dispenser.

A further component of the lock mechanism is a sliding element mounted to the lock housing and movable between a first position closing or narrowing the guide slot and a second position opening the guide slot. In other words, the sliding element only acts on one of the two sections of the guide slot, preferably the first section of the guide slot. It is movable between two positions. In the first position, the guide slot is closed or narrowed so that the bearing pin of the end plug cannot enter the guide slot because the sliding plate obstructs the available space necessary to introduce the bearing pin. In the second position, the sliding element does not impede the proper insertion of the bearing pin into the guide slot.

A further part of the lock mechanism is a lock element mounted to the sliding element and rotationally movable around an axis of rotation. In view of the fact that the lock element is mounted to the sliding element and movable around an axis of rotation, the lock element can perform a complex movement with both a translational and a rotational component. The lock element can be moved so that its engagement portion comes into engagement with a locking means of the lock housing. On the other hand, if the engagement portion of the lock element is out of engagement with the locking means of the lock housing, the lock element can be moved together with the sliding element.

The end plug for a roll of material to be inserted into the above-described lock mechanism comprises a receiving portion with dimensions to fit into a hollow core of the roll of material and a bearing portion including the above-discussed bearing pin. The bearing pin has at least two diameter portions with different outer diameters. A first diameter portion with a larger diameter is closer to the end of the bearing pin remote from the receiving portion. A second diameter portion with a smaller diameter is closer to the fitting portion than the first diameter portion. This is the corresponding geometry necessary for the function of the key-lock-system consisting of the end plug and the dispenser.

There are different possibilities to disengage the engagement portion of the lock element from the locking means of the lock housing. According to a preferred embodiment, the lock element has an abutment portion which, in the locked position, protrudes into the first section of the guide slot. Such an abutment portion, which is preferably nose-shaped can be unlocked by the abutment and sliding contact of the bearing pin within the guide slot. Therefore, no separate means for disengaging the lock element from the locking means of the lock housing is needed. In addition to this, the provision of an abutment portion of the lock element can further be used to establish close tolerances of the specific geometry of the bearing pin needed in order to operate the locking system of the dispenser.

According to a preferred embodiment of the invention, the engagement portion of the lock element is hook-shaped and, in the locked position, provides a form fit engagement with the locking means of the lock housing. This is a highly effective but still simple geometry for the engagement portion of the lock element. A hook-shaped engagement portion can safely prevent the movement of the sliding plate from the first to the second position unless the lock element has been disengaged from the locking means so that there is no longer a form fit engagement.

According to a further preferred embodiment of the invention, an elastic element is provided biasing the lock element into the locked position. The provision of an elastic element makes it possible to implement the lock mechanism of the dispenser in any orientation. No contribution is necessary of gravity forces for a longitudinal shifting of the sliding plate and for the movement of the lock element into the lock position.

According to a preferred embodiment, the elastic element is a leaf spring exerting a biasing force on the lock element at a distance from the axis of rotation of the lock element. This generates a momentum which turns the lock element into the locked position unless a sufficient force acts on the abutment protrusion generating a momentum in the opposite rotational direction disengaging the lock element from the locking means of the lock housing.

In a further preferred embodiment, the sliding element is provided with a bevelled camming surface which, in the first position of the sliding element, protrudes into the guide slot. Such a bevelled camming surface is an easy but effective means to translate a sliding movement of the bearing pin within the guide slot into a translational movement of the sliding element from the first to the second position. To effect such translational movement, the bearing pin contacts and rides down the camming surface of the sliding element. The resulting force acting on such a bevelled surface always generates a force component perpendicular to the longitudinal extension of the guide slot. This force component can be used to effect the sliding movement of the sliding element. Depending on the angle of the bevelled camming surface relative to the insertion direction of the bearing pin, the force component effecting the sliding movement can be adjusted so that a smooth insertion of a replacement roll can still generate a sufficient sliding force to move the sliding plate translationally against the biasing force of a leaf spring acting on the lock element. In view of the fact that the lock element is mounted to the sliding plate, any translational movement of the sliding plate has an impact on the magnitude of the biasing force exerted by the leaf spring.

Depending on specific design variations, the guide slot of the lock mechanism can be either straight or curved. In both cases, the geometry of the guide slot should be selected according to the most comfortable handling of replacement rolls. Depending on the access of the user to the lock mechanism of the dispenser, the geometry of the guide slot can be suitably selected. A straight guide slot is the easiest solution because the movement necessary to insert a replacement roll into the guide slot is as easy as possible.

According to a preferred embodiment, the first width and the second width of the receiving slot are constant when the guide slot is fully opened, i.e. when the sliding element is in the second position. Besides the fact that the provision of a guide slot whose geometry does not change along the insertion direction is the easiest solution, such geometry also ensures that replacement rolls can be inserted and removed wherein the bearing pins of the end plugs receive maximum guidance by the guide slot. It should not be excluded that some sections of the guide slot could have larger dimensions. However, it should be borne in mind that within such sections of the guide slot, there exists an additional freedom of movement of the bearing pin within the guide slot which could make it more difficult for an unskilled user to remove and insert a roll of material into the dispenser.

The lock mechanism is preferably designed such that the position of the abutment portion of the lock element and position of the beveled camming surface of the sliding element are in a well-defined mutual relationship depending on the geometry of the different sections of the guide slot and the corresponding size of the individual portions of the bearing pin of the end plug. Upon insertion of the bearing pin into the guide slot, first the bearing pin exerts a force on the abutment nose of the lock element and articulates the lock element around its axis of rotation out of engagement with the locking means of the lock housing. A further movement of the bearing pin in the insertion direction within the guide slot brings the bearing pin in engagement with the camming surface of the sliding element. As was discussed in detail above, further movement of the bearing pin effects the shifting movement of the sliding element. In other words, the mutual position of the abutment nose and the beveled camming surface have to be such that, for an given geometry of the bearing pin, the lock element is brought out of engagement with the locking means of the lock housing, before the bearing pin engages the camming surface of the sliding element and rides down the sliding element during the translational movement of the sliding element together with the lock element.

To provide an optimum operation of the key-lock-system consisting of the lock mechanism and the end plug, specific dimensions of the end plug should be realized.

According to a preferred embodiment, the end plug comprises a plurality of radially extending ribs on the outer circumference of the receiving portion. Such ribs make it easier to provide a frictional fit connection of the end plug within the hollow core of a paper roll and takes advantage of the limited flexibility of the hollow core of the paper rolls.

In order to limit the depths of insertion of the receiving portion into the hollow core of the roll of material, the end plug preferably further comprises a flange-shaped stop member around the fitting portion and at the end of the fitting portion adjacent to the bearing pin.

Despite of its complex shape, the end plug can be easily produced and, preferably, is integrally extruded from plastics material.

The method for inserting an exchangeable roll of material with at least one of the above described end plugs into a dispenser equipped with a housing and laterally extending receiving means for mounting the above-described lock mechanism thereon, comprises the sequence of several steps as follows: in a first step, a new roll of material is placed into the dispenser such that the first diameter portion of the bearing pin enters the first section of the guide slot and the second diameter portion of the bearing pin enters the second section of the guide slot of the lock mechanism. In a next step, the bearing pin of the end plug is shifted within the guide slot in the insertion direction. This shifting movement is continued until the first diameter portion comes into engagement with the lock element. A continued shifting of the bearing pin of the end plug in the insertion direction effects an articulation of the lock element around its axis of rotation. Such articulation of the lock element is preferably performed against the biasing force of the spring element. The lock element is rotated from the locked position into the unlocked position in which the lock element is out of engagement with the locking means of the lock housing. A continued shifting movement of the bearing pin of the end plug in the insertion direction brings the bearing pin, preferably with its second diameter portion, into engagement with the sliding element, preferably with the beveled camming surface of the sliding element. A further shifting movement of the bearing pin of the end plug within the guide slot in the insertion direction effects the movement of the sliding element from the first position to the second position opening the full width of the guide slot. Finally, a further shifting movement of the bearing pin of the end plug in the insertion direction brings the paper roll into a suitable operation position, preferably at a bottom surface of the guide slot.

BRIEF DESCRIPTION OF THE DRAWINGS

In the following, an embodiment of the invention will be described in detail based on several schematic drawings in which.

DETAILED DESCRIPTION OF A PREFERRED EMBODIMENT

Figure 1:
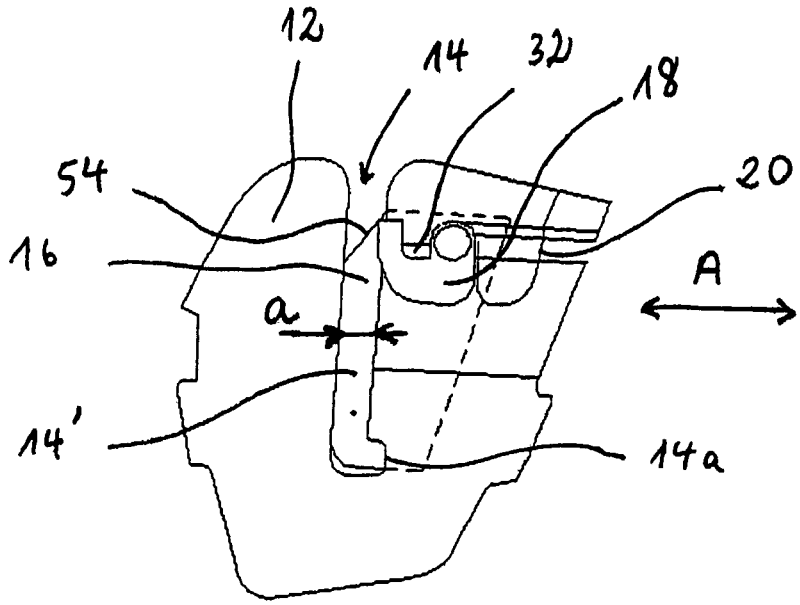
FIG. 1 is a schematic side view of the inventive lock mechanism for a dispenser.

In the following, an embodiment of the invention will be described in detail with reference to the drawings. Throughout the drawings, the same elements will be denoted by the same reference numerals.

FIG. 1 shows the most important parts of the inventive lock mechanism for use in dispensers equipped with an exchangeable roll of material, like tissue paper. The lock mechanism comprises a lock housing 12 which forms a guide slot 14 for receiving the bearing pin of an end plug, which will be described in more detail with reference to FIG. 4. In the example according to FIG. 1, the guide slot extends straight into the lock housing 12 and terminates at a bottom portion 14*a* which has a slightly larger width than the width of the guide slot 14 throughout its remaining longitudinal extension. In view of the fact that FIG. 1 shows a part of a lock mechanism only, it only gives a part of the guide slot 14, namely its first section with the first width a. This first section of the guide slot 14 is denominated 14' and can also be seen from FIG. 3.

In FIG. 1, a sliding plate 16, a lock element 18 and a leaf spring 20 are shown, which will be described in some of the following figures in more detail. The position of the lock element 18 and of the slide plate 16 can be best seen from FIG. 3. Both elements are placed at opposite sides of the lock housing 12, wherein the lock element 18 is provided with a nose-shaped abutment portion 22 which narrows the first section 14' of the guide slot. The position and function of the slide plate, which can be moved in the directions A, will be described later.

Figure 2:
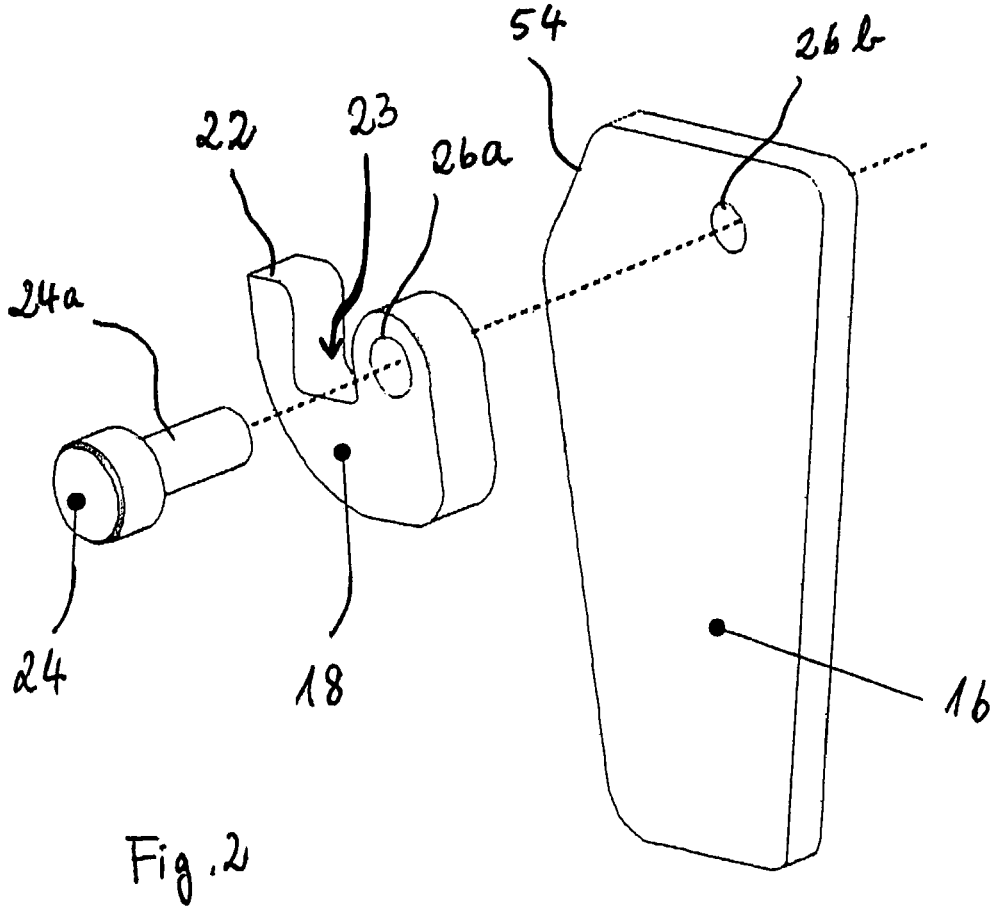
FIG. 2 is an exploded view of a subgroup of the lock mechanism according to FIG. 1 showing in more detail the sliding element and lock element of the lock mechanism.

FIG. 2 shows in more detail the geometry of the lock element 18 and the sliding plate 16 and their coupling together by means of an axle 24. Both the lock element 18 and sliding plate 16 are provided with receiving holes 26*a*, 26*b*, respectively, for receiving the smaller diameter portion 24*a* of the axle 24. Although it may appear so in the schematic drawing of FIG. 2, it should be noted that the lock element 18 and the sliding plate 16 stay at some distance from each other in the mounted condition. The lock housing 12 is provided with a longitudinal slot 28 which can be best seen in FIG. 6. In the specific example according to FIG. 6, this longitudinal slot opens to the backside of the lock housing 12 which simplifies the mounting of the individual parts. However, it should be noted that this is not necessarily the case and it is also possible to provide an elongate hole through which the axle 24 extends. The receiving holes 26*a* and 26*b* are sized such that the lock element 18 can rotate freely around the axle 24 whereas the receiving hole 26*b* is advantageously sized to provide an interference fit with the axle 24.

Figure 6:
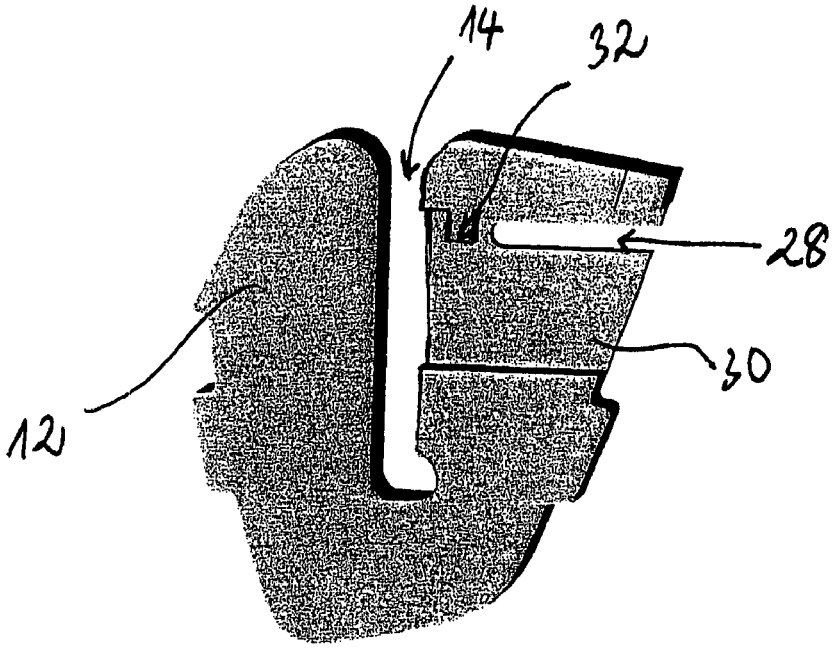
FIG. 6 shows the shape of the lock housing.

As can be best seen from FIG. 6, the lock housing 12 is provided with a recessed portion 30 on the side onto which the lock element is mounted. Into this recessed portion 30, a locking means shaped as a locking nose 32 extends whose function will be explained in more detail later.

The subunit consisting of the sliding plate 16, the lock element 18 and the axle 24 can move together in a translational direction A which is defined by the extension of the longitudinal slot 28. However, the leaf spring 20 as shown in FIG. 1 is fixed to the lock housing 12 and exerts a biasing force against the lock element 18. The position at which the biasing force of the leaf spring 20 presses onto the lock element is at some distance from the axle 24 so that the lock element 18, which can freely rotate around the axle 24, receives a momentum which tends to turn the lock element 18 in a direction which, in FIG. 1, corresponds to a clockwise direction.

As outlined above, the lock element 18 is provided with a nose-shaped abutment portion 22 which serves a double function. On the one hand, it protrudes into the guide slot 14 and especially its section 14' with larger width and can be operated by the bearing pin of an end plug. The second function of the nose-shaped abutment portion 22 is to form an engagement portion 23 which can grip around the locking nose 32 and prevents the shifting of the lock element 18 and the sliding plate 16 in direction A (see FIG. 1) within the longitudinal slot 28. A different geometry of the lock element could provide separate protrusions to act as an abutment portion 22 and engagement portion 23, respectively. The leaf spring 20 also has a double function. It shifts the subunit consisting of lock element 18, sliding plate 16 and axle 24 within the longitudinal slot 28 until the axle 24 reaches the end of the longitudinal slot 28 which is closest to the guide slot 14. The second function is to generate a momentum which turns the lock element into its locked position in which the nose-shaped abutment portion 22 grips around the locking nose 32 of the lock housing.

Figure 3:
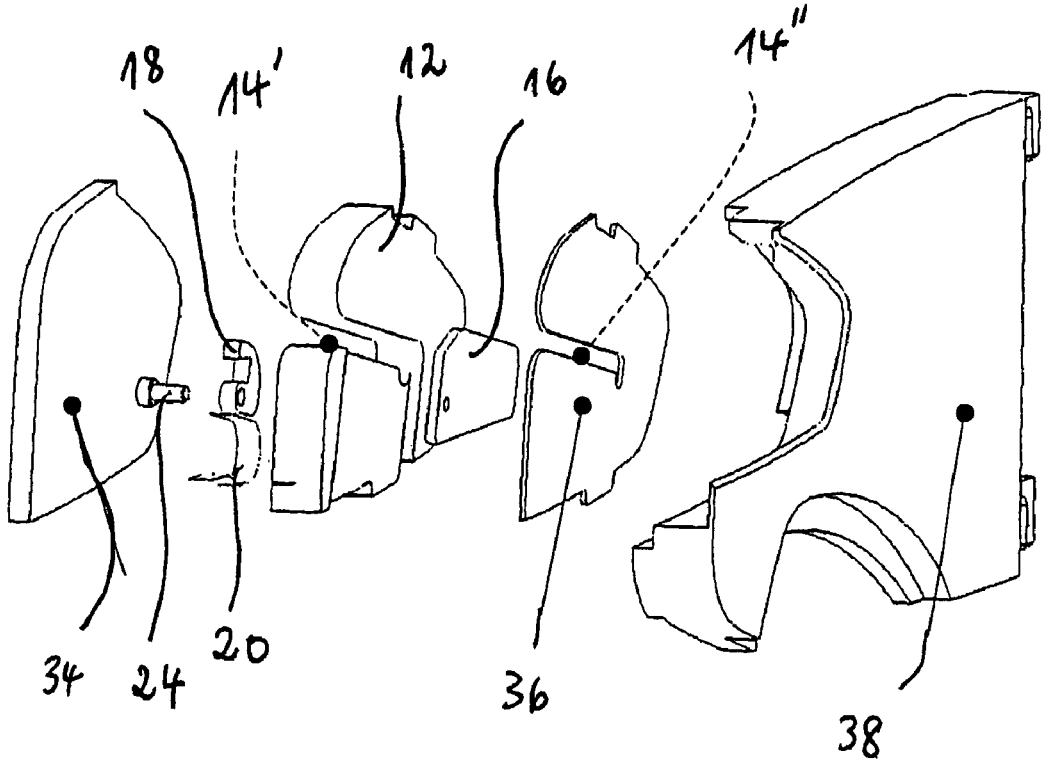
FIG. 3 is an exploded view of the inventive lock mechanism and its holding element.

FIG. 3 also shows the arrangement of the above-described unit consisting of the lock housing 12, sliding plate 16, lock element 18, leaf spring 20 and axle 24 within the lock mechanism. On the side of the lock housing 12 on which the lock element 18 and leaf spring 20 are mounted, a back plate is provided. On the side of the lock housing 12 at which the sliding plate 16 is mounted, there is a front plate 36. All those parts are mounted together within a holder 38 which serves as the housing for the lock mechanism. The front plate 36 is also provided with a section of the guide slot, namely the second section 14" thereof. The second section of the guide slot 14" within the front plate 36 has a smaller width than the width of the first section 14' of the guide slot. In other words, the guide slot is subdivided into two different sections, wherein the first section 14' has a larger width than the second section 14". In order to provide easy sliding of the end plugs of a paper roll in the guide slot, the width of both sections should slightly exceed the diameter of the corresponding portions of the end plug.

Figure 7:
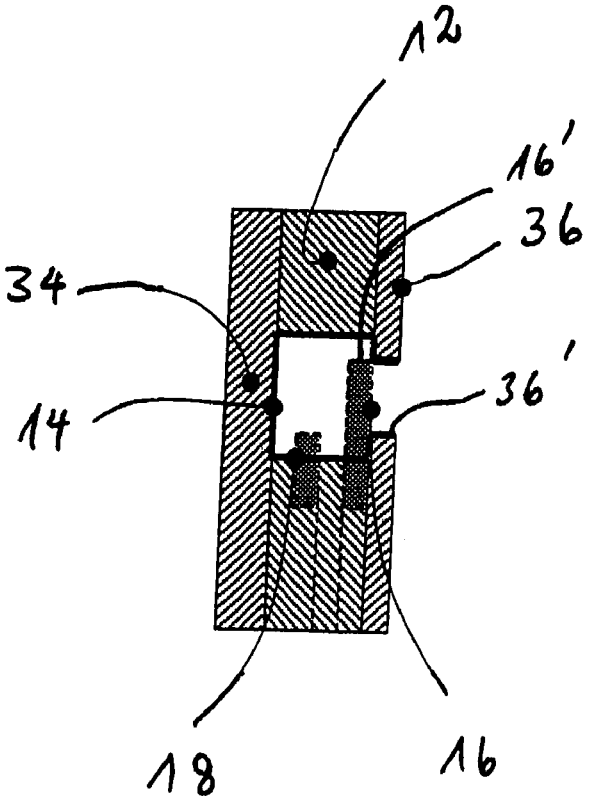
FIG. 7 is a cross-sectional view of the lock mechanism.

FIG. 7 shows a cross-sectional view of the lock mechanism and especially the T-shape of the guide slot 14 and the position of the lock element 18 and sliding plate 16 within the guide slot 14. It can be seen, that the lock element protrudes into the first section of the guide slot whereas the sliding plate 16 is positioned next to the front plate 36 forming a slot of smaller width corresponding to the second section of the guide slot. Nevertheless, it will be shown later that it is the large diameter of the end plug acting on the lock element 18, whereas it is the small diameter of the end plug which engages the sliding plate 16 and moves it sufficiently to the side so that it fully opens the second, smaller section of the guide channel 14. In other words, the sliding plate 16 is only translationally moved to an extent such that the front face 16' of the sliding plate 16 lies within the same plane as the front side 36' delimiting the second section of the guide slot.

Figure 4:
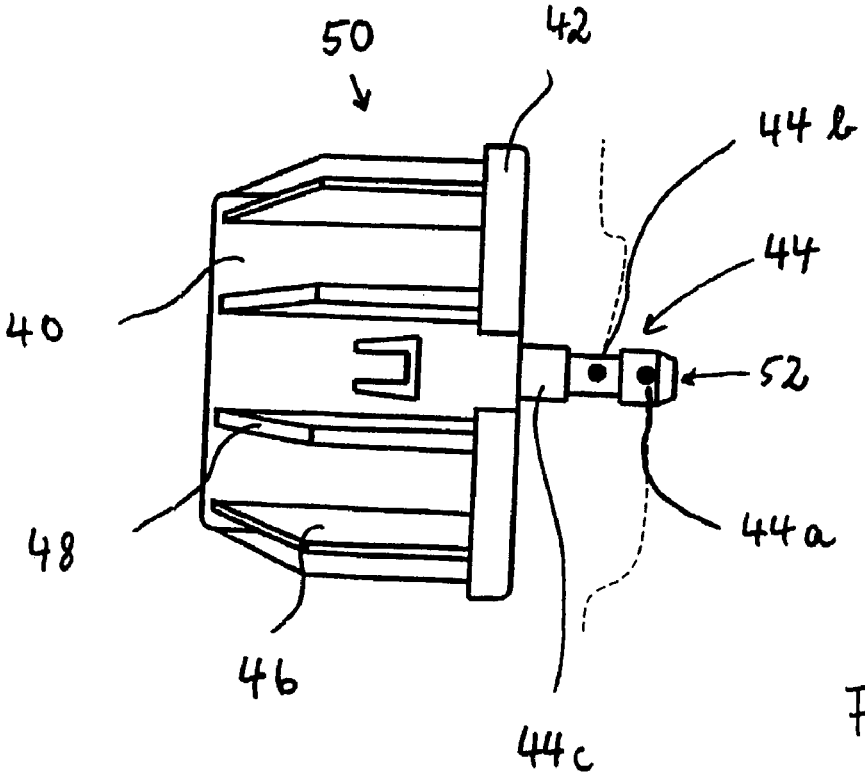
FIG. 4 is a schematic view of an end plug for use in combination with the lock mechanism according to FIGS. 1 to 3.

FIG. 4 shows the corresponding end plug for use in the lock mechanism according to FIG. 3. The end plug is preferably integrally formed of plastics material and mainly consists of a receiving section 40 an abutment flange 42 and the bearing pin 44.

The receiving section 40 has a cylindrical shape and is provided with engagement ribs 46 which extend radially outwards. The engagement ribs serve to contact the inner surface of the hollow core of a paper roll after the end plug 50 has been inserted into at least one end of the hollow core. The engagement ribs 46 are provided with bevelled sections which serve to make easier the insertion of the plug into the core. The end plug 50 as shown in FIG. 4 is inserted into the hollow core of a paper roll until the longitudinal end faces of the hollow core abut against the abutment flange 42.

The bearing pin 44 of the end plug 50 has a longitudinal end 52 remote from the abutment flange 42. Moreover, the bearing pin 44 is provided with different diameter portions. A first diameter portion closer to the longitudinal end 52 is denoted 44*a* and has a larger diameter than a second diameter portion 44*b* further remote from the longitudinal end 52. IN the specific example shown in FIG. 4 there is a third diameter portion 44*c*, however, this portion has no function for operating the lock mechanism as described above. The first diameter portion 44*a* with a larger diameter has a maximum diameter of 5, 2 mm+/−0, 1 mm and a maximum longitudinal extension of less than or equal to 5 mm. The second diameter is smaller that the first diameter portion 44*a* but larger than 1, 0 mm+/−0, 1 mm. Preferably, the second diameter portion 44*b* has a diameter around 3, 5 mm. The second diameter portion has a longitudinal extension exceeding 1 mm, preferably a longitudinal extension exceeding 2 mm. As will be shown in more detail from the sequence of operation shown in FIGS. 5*a* to *5c*, such specific diameters are necessary to operate the inventive lock mechanism.

Figure 5A:
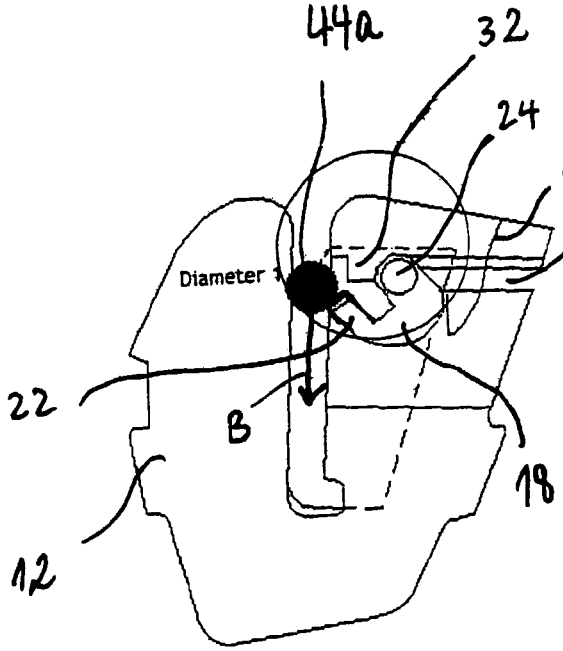
FIGS. 5*a* and 5*c* diagrammatically show the sequence of operation of the inventive lock mechanism in combination with an end plug of an exchangeable roll of material.

Turning to FIG. 5*a*, the operation of the lock mechanism is shown. As can be seen, an end plug, from which only the cross-section of the first diameter portion 44*a* is shown, is introduced into the guide slot and abuts against the nose-shaped abutment portion 22 of the lock element 18. Accordingly, the insertion movement of the plug in direction B acts to rotate the lock element 18 against the biasing force of the leaf spring 20 around its rotational axis embodied by the axle 24 so that the lock element 18 comes out of engagement of the locking nose 32 of the lock housing 12. Up to the point of time in which the lock element has been sufficiently rotated to be out of engagement with the locking nose 32, it is only the first diameter portion 44*a* of the bearing pin which acts on the inventive lock mechanism.

As soon as the lock element 18 has come out of engagement with the locking nose 32, the subunit consisting of the lock element, the sliding plate and the axle can move in the direction A (see FIG. 1) within the guide slot 28. In this operational phase, a further movement of the bearing pin within the guide slot brings the second diameter portion 44*b* of the bearing pin into contact with the bevelled camming surface 54 of the sliding element 16 (see FIGS. 1, 2). A further movement of the bearing pin in direction B effects a riding down of the second diameter portion 44*b* on the bevelled camming surface 54 which effects a sliding movement of the sliding plate 16 in direction C. Such a sliding movement in direction C is possible because the lock element 18 is no longer in engagement with the locking nose of the lock housing 12 so that both the sliding plate 16 and the lock element 18 connected thereto via the axle 24 are shifted within the longitudinal slot 28 to open the channel.

Figure 5C:
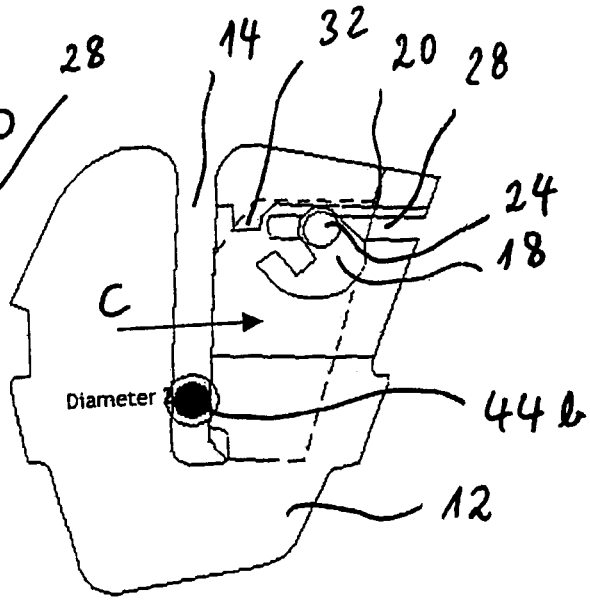
Figure 5B:
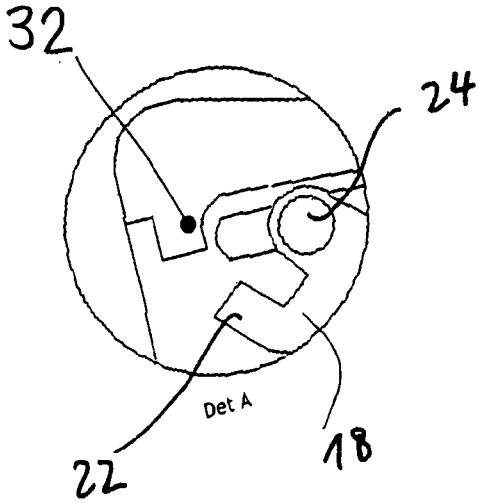
FIG. 5*b* is an enlarged view of the detail according to FIG. 5*a;*
Figure 8C:
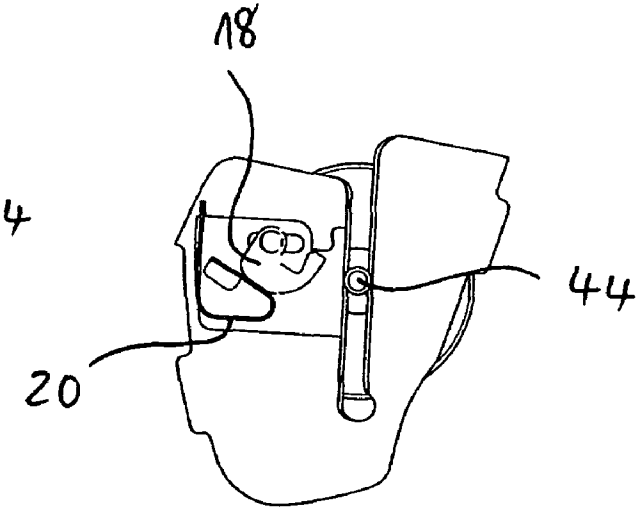
FIG. 8*a* to 8*c* show the sequence of inserting a paper roll into the lock mechanism according to another embodiment.
Figure 8B:
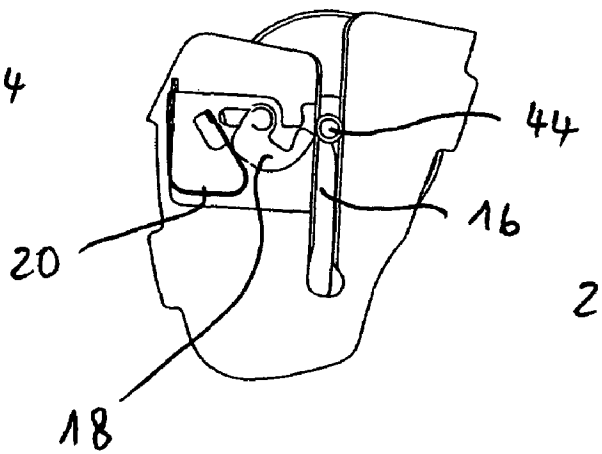
Figure 8A:
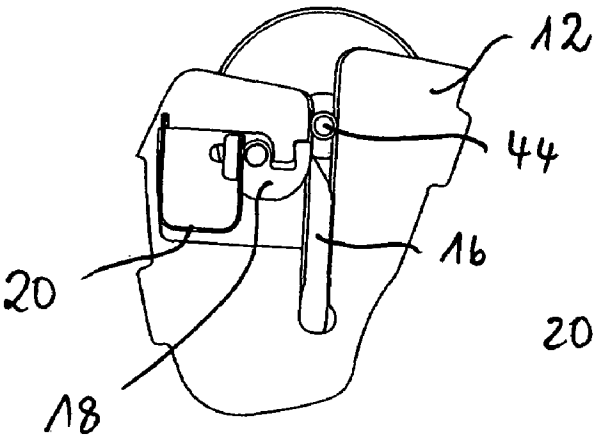

A further movement of the bearing pin 44 down within the guide slot and up to the bottom of the guide slot keeps the sliding plate 16 in the position shown in FIG. 5*c* as long as the bearing pin obstructs the movement of the sliding plate 16 back into its original position narrowing or closing the guide slot. In the example shown in FIG. 5*c*, the sliding plate 16 has extensions which prevent the closing of the guide slot 14 as long as the bearing pin is inserted in the guide slot. However, according to an alternative embodiment (not shown) the sliding plate 16 can have dimensions such that the sliding plate closes again the guide slot as soon as the bearing pin reached its operation position. In that case, care has to be taken to enable the removal of a roll of material from the lock mechanism. In other words, in such a case the lock element has to be shaped such that it has a further abutment portion which can be operated by a bearing pin fully inserted into the guide slot such that the unlocking function described with reference to FIG. 5*a* can also be performed at a position in which the bearing pin is fully inserted into the guide slot. The sequence of FIGS. 8*a* to 8*c* show the insertion of a roll into a lock mechanism according to another embodiment of the invention. The lock mechanism is very similar to that according to the previous embodiments. The only difference besides a different shape of the leaf spring 20 is the fact that the lock mechanism according to FIGS. 8*a*-8*c* is a mirror image to the lock mechanism according to FIG. 1. The function of the lock mechanism according to FIGS. 8*a*-8*c* is the same as that described above for the other embodiments.

The above described locking mechanism can only be operated by means of an end plug whose bearing pin has well-defined dimensions which allow its insertion into the different sections of the guide slot and allow the complete unlocking of the lock element before the shifting movement of the sliding plate 16 to open the guide channel starts. Therefore, for the inventive lock mechanism, the correspondingly shaped end plug is an essential element like a key without which the lock mechanism cannot be operated.

The invention claimed is:

1. Lock mechanism for a dispenser in combination with an exchangeable roll of material, the roll being provided with at least one end plug with a bearing pin for mounting the roll to the lock mechanism of the dispenser, comprising:

a lock housing with a guide slot for insertion of the bearing pin, the guide slot having a first section with a first width and a second section with a second width which is smaller than the first width, the first section and second section being arranged in a direction perpendicular to a longitudinal extension of the guide slot and in a longitudinal direction of the bearing pin to be received;

a sliding element mounted to the lock housing and movable between a first position closing or narrowing the guide slot and a second position opening the guide slot;

a lock element rotationally mounted to the sliding element and rotationally movable around an axis of rotation between a locked position and an unlocked position;

the lock element being provided with an engagement portion which, in the locked position, is engaged with a locking means of the lock housing.

2. Lock mechanism according to claim 1, wherein the lock element has an abutment portion which, in the locked position, protrudes into the first section of the guide slot.

3. Lock mechanism according to claim 2, wherein the sliding element is provided with a beveled camming surface which, in the first position of the sliding element, protrudes into the guide slot.

4. Lock mechanism according to claim 3, wherein a mutual position of the abutment portion of the lock element and the beveled camming surface of the sliding element are such that, upon insertion of the bearing pin, first the bearing pin exerts a force on the abutment portion and articulates the lock element out of engagement with the locking means of the lock housing; and then the bearing pin engages the camming surface of the sliding element.

5. Lock mechanism according to claim 1, wherein the engagement portion of the lock element is hook-shaped and, in the locked position, provides a form fit engagement with the locking means of the lock housing.

6. Lock mechanism according to claim 1, further comprising an elastic element biasing the lock element into the locked position.

7. Lock mechanism according to claim 6, wherein the elastic element comprises a leaf spring exerting a biasing force on the lock element at a distance from the axis of rotation of the lock element.

8. Lock mechanism according to claim 1, wherein the sliding element, in the first position, narrows the first section of the guide slot.

9. Lock mechanism according to claim 1, wherein the guide slot is straight.

10. Lock mechanism according to claim 1, wherein guide slot is curved.

11. Lock mechanism according to claim 1, wherein the first width and the second width of the guide slot are constant over the longitudinal extension of the guide slot when the sliding element is in the second position.

12. Lock mechanism according to claim 1 in combination with an end plug for a roll of material comprising:

a receiving portion with dimensions to fit into a hollow core of the roll of material;

an abutment flange for abutment against the hollow core of the roll of material; and a bearing portion including a bearing pin with a first end adjacent the abutment flange, and a second end remote from the abutment flange; wherein the bearing pin has a first diameter portion closer to the second end of the bearing pin, a second diameter portion further remote from the second end, and a third diameter portion between the abutment flange and the second diameter portion, the second diameter portion having a smaller diameter than the first diameter portion and the third diameter portion.

13. Lock mechanism in combination with the end plug according to claim 12, wherein the first and second diameter portions are contiguous with each other.

14. Lock mechanism in combination with the end plug according to claim 12, wherein the first diameter portion has an outer diameter of at least 5 mm and the second diameter portion has an outer diameter of 3.5 mm or less and an axial length exceeding 1 mm.

15. Lock mechanism in combination with the end plug according to claim 12, further comprising a plurality of radially extending ribs on an outer circumference of the receiving portion.

16. Lock mechanism in combination with the end plug according to claim 12, wherein the abutment flange comprises a flange-shaped stop member around the receiving portion to limit depth of insertion of the receiving portion into the hollow core of the roll of material.

17. Lock mechanism in combination with the end plug according to claim 12, wherein the end plug is integrally extruded from plastics material.

18. The lock mechanism in combination with the end plug of claim 17, wherein the plastics material comprises polypropylene or polyethylene.

19. Lock mechanism in combination with the end plug according to claim 12, the end plug fitting into the hollow core of the roll of material.

20. The lock mechanism in combination with the end plug according to claim 19, wherein the roll of material comprises a paper towel roll or a tissue paper roll wound around the hollow core.

21. Lock mechanism in combination with the end plug according to claim 12, wherein the end plug fits at least at one longitudinal end of the roll.

22. The lock mechanism in combination with the end plug of claim 21, wherein the roll comprises tissue paper roll.

23. The lock mechanism according to claim 1, in combination with:

a holder having laterally extending receiving means for mounting the lock mechanism.

24. Method for inserting an exchangeable roll of material with at least one end plug into the lock mechanism of claim 1, the end plug including a bearing pin having a distal first diameter portion of greater diameter than a less distal second diameter portion, comprising the steps of:

(i) placing the roll of material into the lock mechanism such that the first diameter portion of the bearing pin enters the first section of the guide slot and the second diameter portion of the bearing pin enters the second section of the guide slot;

(ii) shifting the bearing pin of the end plug within the guide slot such that the first diameter portion comes into engagement with the lock element;

(iii) further shifting the bearing pin of the end plug within the guide slot and effecting an articulation of the lock element around its axis of rotation from the locked position to the unlocked position in which the lock element is out of engagement with the locking means of the lock housing;

(iv) further shifting the bearing pin of the end plug within the guide slot such that the bearing pin comes into engagement with the sliding element;

(v) further shifting the bearing pin of the end plug within the guide slot such that the sliding element is shifted from the first position to the second position; and (vi) further shifting the bearing pin of the end plug within the guide slot until the bearing pin reaches an operation position.

25. Method according to claim 24, wherein, in steps (iii) and (v), the shifting of the bearing pin is effected with a force sufficient to overcome a biasing force of an elastic element.

26. Method according to claim 24, wherein, in step (iv) the second diameter portion of the bearing pin comes into engagement with the sliding element.

27. The method according to claim 24, wherein the operation position is at a bottom of the guide slot.

* * * * *